US010775033B2

(12) United States Patent
Zanotto et al.

(10) Patent No.: US 10,775,033 B2
(45) Date of Patent: Sep. 15, 2020

(54) CONNECTOR FOR LIGHTING DEVICES AND CORRESPONDING METHOD

(71) Applicant: OSRAM GmbH, Munich (DE)

(72) Inventors: Alberto Zanotto, Padua (IT); Simon Bobbo, Mirano (IT); Valerio Michielan, Scorze (IT); Andrea Morra, Padua (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/151,522

(22) Filed: May 11, 2016

(65) Prior Publication Data

US 2016/0334090 A1 Nov. 17, 2016

(30) Foreign Application Priority Data

May 12, 2015 (IT) ..... 102015000014768

(51) Int. Cl.

| | |
|---|---|
| ***F21V 23/06*** | (2006.01) |
| ***F21S 4/28*** | (2016.01) |
| ***F21S 4/24*** | (2016.01) |
| ***F21V 23/00*** | (2015.01) |
| ***F21V 3/04*** | (2018.01) |
| ***F21V 21/005*** | (2006.01) |
| ***F21S 4/22*** | (2016.01) |
| ***H05B 45/10*** | (2020.01) |
| *H01R 25/16* | (2006.01) |
| *F21Y 115/10* | (2016.01) |

(Continued)

(52) U.S. Cl.

CPC ..... *F21V 23/06* (2013.01); *F21S 4/22* (2016.01); *F21S 4/24* (2016.01); *F21S 4/28* (2016.01); *F21V 3/04* (2013.01); *F21V 21/005* (2013.01); *F21V 23/001* (2013.01); *H05B 45/10* (2020.01); *F21Y 2101/00* (2013.01); *F21Y 2103/10* (2016.08); *F21Y 2115/10* (2016.08); *H01R 25/16* (2013.01)

(58) Field of Classification Search

USPC ..... 362/219

See application file for complete search history.

(56) References Cited

U.S. PATENT DOCUMENTS 4,413,311 A * 11/1983 Orenstein ..... E05B 1/0015 362/145
6,074,074 A * 6/2000 Marcus ..... B29C 45/14655 362/240

(Continued)

FOREIGN PATENT DOCUMENTS

DE 102005027371 A1 12/2006
EP 2157357 A1 2/2010

OTHER PUBLICATIONS

Italian Search Report based on Application No. 102015000014768(6 Pages) dated Sep. 29, 2015 (Reference Purpose Only).

(Continued)

*Primary Examiner* — Michael G Lee
*Assistant Examiner* — David Tardif
(74) *Attorney, Agent, or Firm* — Viering, Jentschura & Partner MBB

(57) ABSTRACT

A connector for connecting mutually facing ends of elongate lighting devices is provided. The connector includes a connector body having opposed end regions coupleable to the facing ends of said lighting devices. The connector body includes a light emission region between the opposed end regions.

10 Claims, 3 Drawing Sheets

(51) Int. Cl.
*F21Y 103/10* (2016.01)
*F21Y 101/00* (2016.01)

(56) References Cited

U.S. PATENT DOCUMENTS

| | | | | |
|---|---|---|---|---|
| 7,331,681 | B2 * | 2/2008 | Pohlert | F21V 14/06<br>348/E5.029 |
| 2008/0266843 | A1 * | 10/2008 | Villard | F21S 4/28<br>362/147 |
| 2009/0147504 | A1 * | 6/2009 | Teeters | F21S 2/005<br>362/153 |
| 2012/0001554 | A1 * | 1/2012 | Leadford | F21V 29/76<br>315/158 |
| 2014/0218924 | A1 * | 8/2014 | Levante | F21V 23/06<br>362/249.04 |
| 2015/0104971 | A1 | 4/2015 | Staeber et al. | |
| 2015/0235735 | A1 * | 8/2015 | Schrader | H02G 15/18<br>174/84 R |

OTHER PUBLICATIONS

European Office Action based on application No. 16 168 178.8 (4 pages) dated Dec. 5, 2017 (Reference Purpose Only).

* cited by examiner

CONNECTOR FOR LIGHTING DEVICES AND CORRESPONDING METHOD

CROSS-REFERENCE TO RELATED APPLICATION

This application claims priority to Italian Patent Application Serial No. IT 102015000014768, which was filed May 12, 2015, and is incorporated herein by reference in its entirety.

TECHNICAL FIELD

The present description relates to lighting devices.

One or more embodiments may refer to lighting devices employing electrically powered light radiation sources, for example solid-state light radiation sources such as LED sources.

BACKGROUND

In the field of lighting technology, over the last few years elongate lighting devices have increasingly been used which include an elongate carrier structure, which may be flexible, on which electrically powered light radiation sources are mounted sequentially. The latter may be comprised e.g. of solid-state light radiation sources, e.g. LED sources, which are distributed on the carrier as a linear array with constant pitch.

In implementing a lighting device by coupling a plurality of such modules (which are currently named "flex" modules when they exhibit flexibility), it may be difficult to keep the same pitch in the region of mutually facing end or front portions of two subsequent modules.

For instance, if in the coupling region there is provided a connection to a power supply line, in the coupling area the light radiation sources may be separated by a wider distance than the pitch of the sources provided on the modules being mutually connected. This may lead to an irregularity of the light flux emitted by the device (in other words, a region which is at least slightly darker than the rest of the device), which is perceived negatively.

SUMMARY

A connector for connecting mutually facing ends of elongate lighting devices is provided. The connector includes a connector body having opposed end regions coupleable to the facing ends of said lighting devices. The connector body includes a light emission region between the opposed end regions.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIGS. 10 and 11, wherein FIG. 11 is a cross-section view along line XI-XI of FIG. 10, show a connector according to one or more embodiments.

DESCRIPTION

In the following description, numerous specific details are given to provide a thorough understanding of one or more exemplary embodiments. One or more embodiments may be practiced without one or several specific details, or with other methods, components, materials, etc. In other instances, well-known structures, materials or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or meaning of the embodiments.

The Figures show the possibility of implementing composite or modular lighting devices by mutually coupling, at mutually facing ends, a plurality of elongate (e.g. ribbon-shaped) modules M, including a carrier on which there are mounted electrically powered light radiation sources L, such as solid-state light radiation sources, e.g. LEDs.

Such elongate modules M may be implemented either as bars or—according to an increasingly widespread configuration—as flexible ribbon-shaped elements which are named "flex" modules, adapted to modify their shape. In order to achieve a uniform distribution of the light emission along the length of module M, sources L may be distributed along each module M with a uniform pitch.

Said modules are well known in the prior art, and therefore do not require a detailed description herein.

In implementing composite or modular lighting devices by connecting or coupling a plurality of such modules M, it is desirable to obtain a uniform distribution of the light emission along the whole length of the device.

Figure 1:
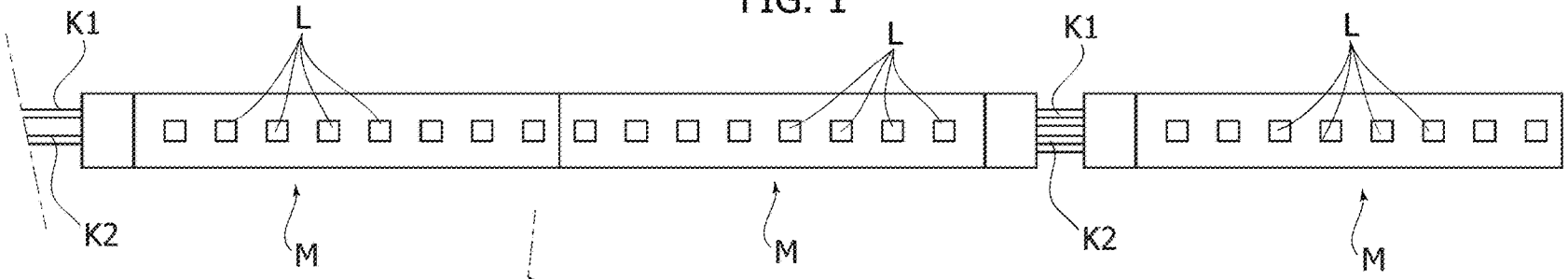
FIG. 1 is a view showing a lighting device implemented by connecting a plurality of lighting modules to one another.

In some cases, as exemplified by the connection between the first and the second module (from the left) of FIG. 1, in the butt-connection of mutually facing ends of two modules M it is possible to keep a uniform pitch among the LEDs.

In other cases, as exemplified in the connection between the second and the third module (again, from the left), e.g. due to the presence of electrical power supply connectors K1, K2, there may arise a modification in the spacing pitch from one light radiation source L to another, so that at the connection there may be e.g. a pitch which is wider than the pitch of sources L on the individual modules M.

Therefore, an irregularity arises in the light radiation emission due to the presence of an area which, when the device is turned on, will appear as at least slightly less bright (i.e. darker) than the neighbouring areas.

Figure 2:
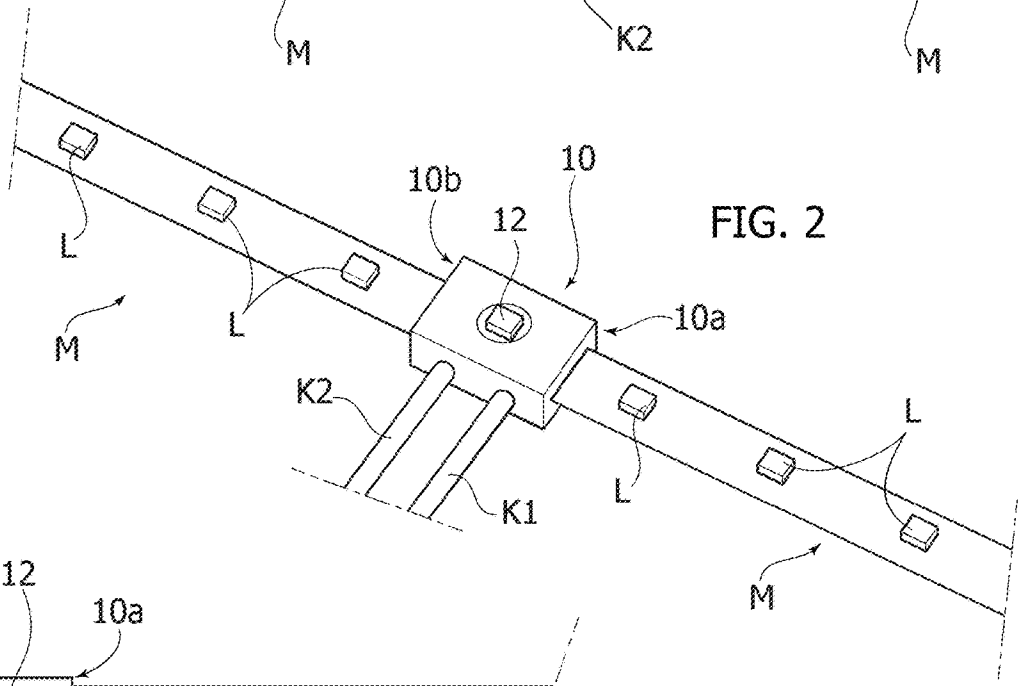
FIGS. 2 and 3 are respectively a perspective and a plan view showing a connector according to one or more embodiments.
Figure 3:
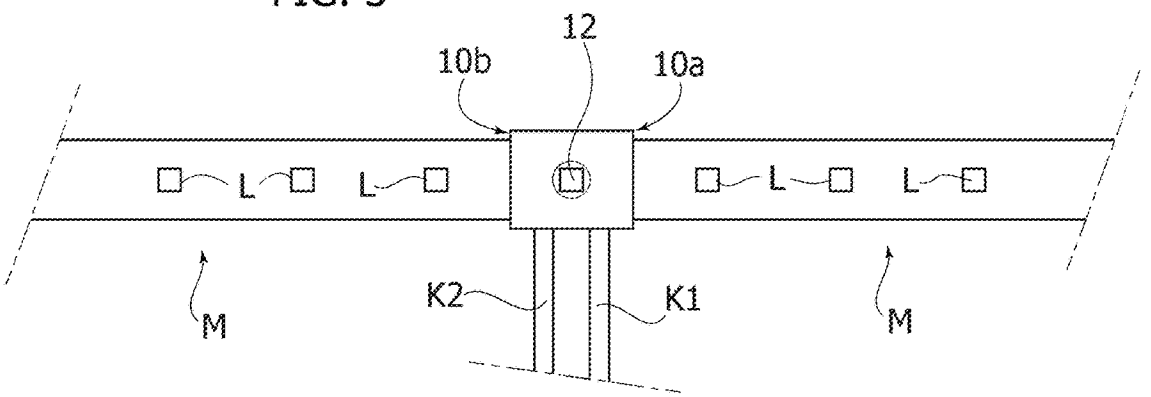
Figure 4:
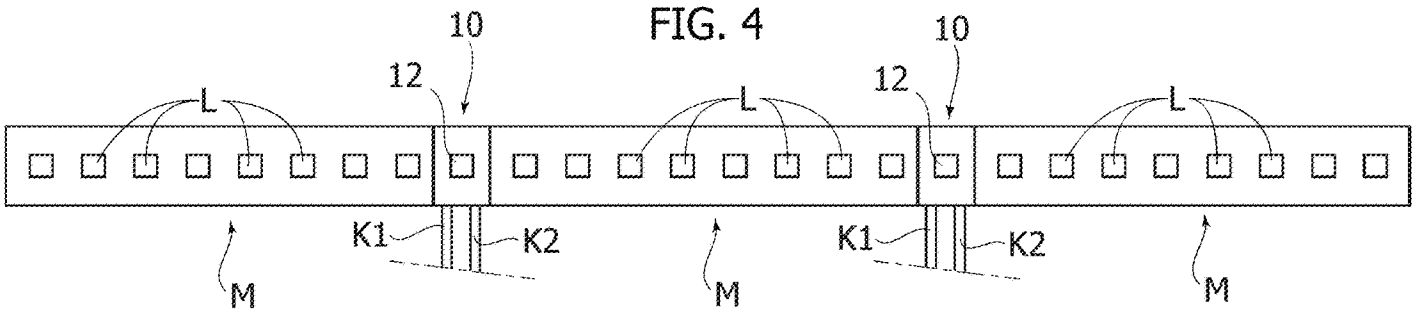
FIG. 4 exemplifies the possible use of a connector according to FIG. 2 and FIG. 3 in a context as shown in FIG. 1.
Figure 7:
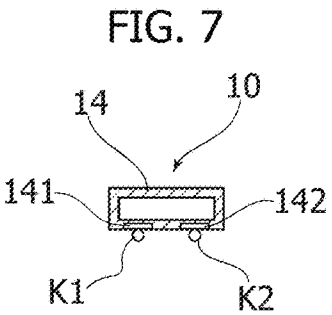
FIGS. 5, 6 and 7, wherein FIG. 7 provides a cross-section view along arrow VII-VII of FIG. 6, show a connector according to one or more embodiments.
Figure 6:
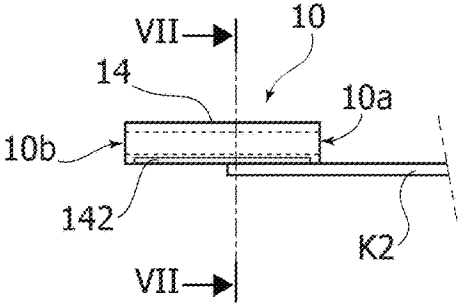

One or more embodiments, as exemplified in FIG. 2 to FIG. 4, may be adapted to counter the possible appearance of such "shadow areas" by using a connector 10 having:

- opposed end portions 10*a* and 10*b*, adapted to be coupled with the mutually facing ends of modules M being connected to each other, and
- a portion lying between both opposed ends 10*a*, 10*b*, which is adapted to act as a light emission region.

In one or more embodiments as exemplified in FIG. 2 to FIG. 4, such a result may be achieved via a light emission region of an "active" type, i.e. by mounting, onto connector body 10 in that region, at least one light radiation source 12.

The source may comprise, in one or more embodiments, an electrically powered radiation source 12 such as a solid-state light radiation source, e.g. a LED source, which is substantially similar to sources L arranged on modules M connected through connector 10.

In one or more embodiments, the size of connector 10 and the mounting position of source 12 may be chosen so that, when two modules M are connected to each other via connector 10, as exemplified in FIG. 2 to FIG. 4, the distribution of sources L (on modules M) and 12 (on module 10) may have a substantially constant pitch, so as to avoid lacks of uniformity in the light flux emitted by the device, when it is energized.

In one or more embodiments as presently exemplified, connector 10 may be implemented as a body having an at least approximately tubular shape (e.g. a parallelepid) with openings at the opposed ends 10*a*, 10*b*, wherein it is possible to insert the facing ends of modules M connected via connector 10, so that the connector may be coupled with the mutually facing ends of modules M coupled to each other.

Figure 11:
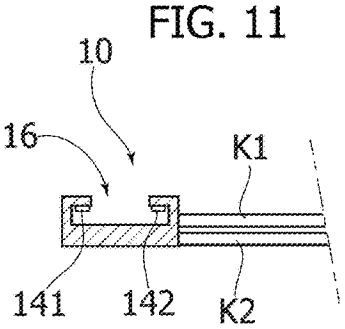

FIG. 2 to FIG. 4 exemplify the possible presence of electrical cables K1, K2, which e.g. enable to supply source 12 and/or to provide for the electrical supply to sources L provided on modules M through electrical contacts, e.g. sliding contacts, which are not visible in these Figures but which may be e.g. substantially similar to connectors 141, 142 shown in FIG. 11 with reference to the embodiments exemplified therein.

Source 12 (which may optionally include an array, e.g. a focused array, of single LEDs) enables the achievement of a uniform light emission along the whole length of the lighting device.

In one or more embodiments, source 12 may be fed via an electrical drive circuit integrated in connector 10, which in turn can be supplied by cables K1, K2, so that source 12 exhibits the same brightness as the other sources L. For example, in one or more embodiments, such a drive circuit may be regulated by a resistor having a variable value, so as to obtain a fine adjustment of the brightness level.

In one or more embodiments, connectors 10 may be provided having a pitch and/or brightness features corresponding to sources L arranged on modules M.

Figure 5:
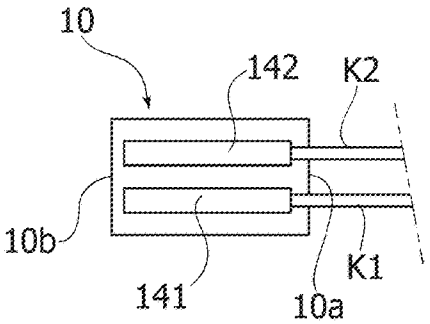

In comparison with the embodiments exemplified in FIG. 2 to FIG. 4, wherein the light emitting region is of the "active" kind (due to the presence of source 12), FIG. 5 and following exemplify possible embodiments wherein on connector 5 there can be provided a "passive" light emitting region.

In this case, connector 10 may be implemented so that it includes, between opposing ends 10*a*, 10*b*, a region emitting a light radiation propagating from sources L arranged on modules M, so that connector 10 may not include a light radiation source.

FIG. 5 to FIG. 9 exemplify embodiments which may be used e.g. with modules M wherein light radiation sources L are not exposed and/or individually perceivable from the outside, e.g. because they are sunk within the body of respective module M, made of a transparent material, e.g. a silicone material which is adapted to diffuse light radiation. In this case, too, these are modules M which are well known, and which therefore do not require a detailed description herein.

In one or more embodiments, as exemplified in FIG. 5 to FIG. 9, connector 10 may be implemented as a (once again as an approximately tubular) body which may be coupled to the mutually facing ends of modules M connected to each other.

In one or more embodiments, as exemplified in FIG. 5 to FIG. 9, connector 10 may be comprised of a light-permeable material (e.g. a transparent silicone material, e.g. similar to the material forming the body of modules M).

In this way, connector 10 may comprise, between opposed ends 10*a*, 10*b*, a region 14 which emits a radiation propagating from sources L arranged on modules M, i.e. a region 14 which may merely serve as a waveguide (or, more generally, as a propagation path) for the light radiation emitted by light radiation sources L which are arranged at the mutually facing ends of modules M coupled to each other.

In this case, as well, in connector 10 there may be provided two power supply cables K1, K2 connected to electrical contacts 141, 142, which for example may be comprised of boards adapted to perform the transfer of a power supply from the electrically conductive lines which are arranged (according to a method known in itself) on the carriers of modules M, which are coupled via connector 10.

Figure 8:
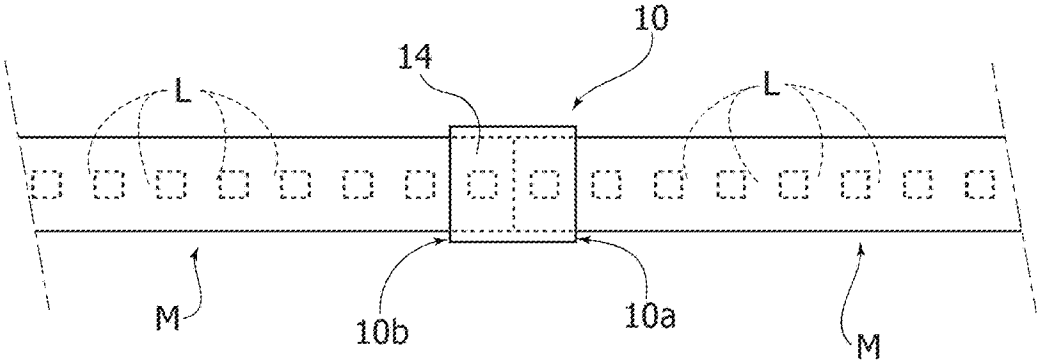
FIGS. 8 and 9 show possible applications of a connector as shown in FIG. 10 and FIG. 11.
Figure 9:
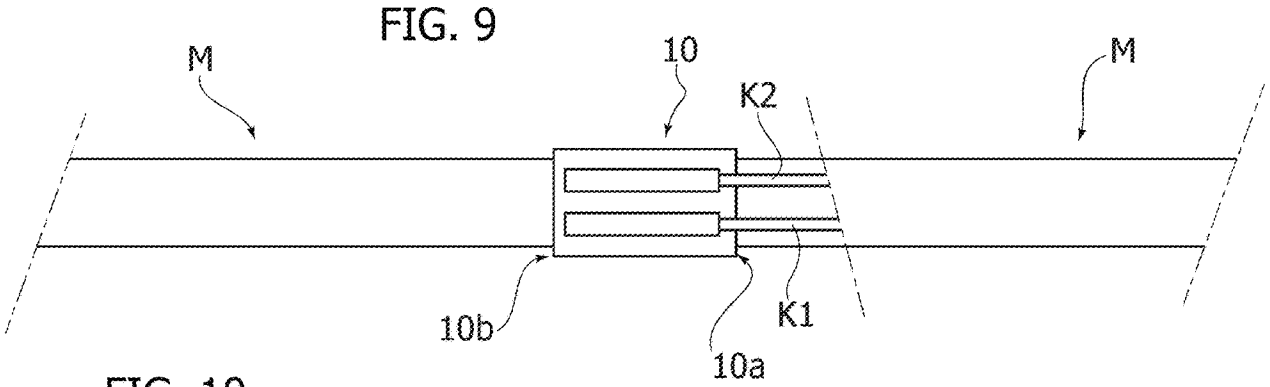

As exemplified in the view of FIG. 8, also in this case in one or more embodiments pitch uniformity may be provided in the arrangement of sources L and, in any case, a uniform distribution may be achieved for the light radiation flux emitted along the whole length of the device obtained by connecting a plurality of modules M.

Figure 10:
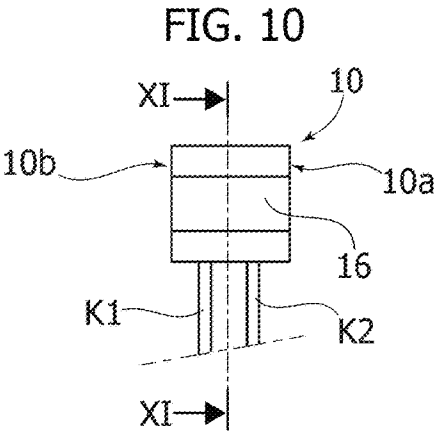

In one or more embodiments as exemplified in FIG. 10 to FIG. 12, once again the possibility is offered to obtain a "passive" light emission region by providing, within connector body 10, between opposed ends 10*a*, 10*b*, a region wherefrom a light radiation propagates from sources L arranged on modules M. This may include or consist for example of a front window 16 exposing those light radiation sources L which are located at the mutually facing ends of modules M being connected to each other.

Figure 12:
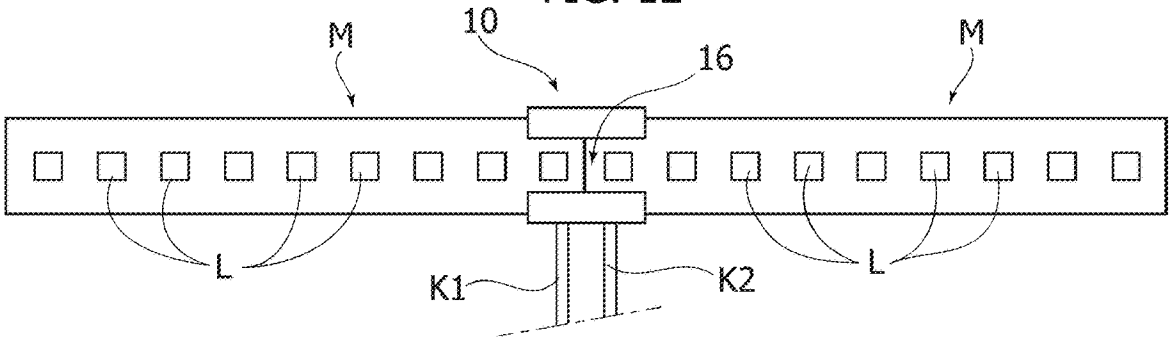
FIG. 12 shows possible applications of a connector as exemplified in FIG. 10 and FIG. 11.

Such a result may be obtained, as exemplified in FIG. 10 to FIG. 12, by conferring a general C-shaped configuration to connector body 10, so that connector 10 may be so to say be "spliced" on the mutually facing ends of modules M connected to each other, as exemplified in FIG. 12.

In this case, as well, power supply cables K1, K2 may be provided which are connected to metal contacts 141, 142, which may act as sliding contacts towards electrically conductive lines which are present (in a manner known in itself) on modules M coupled to each other, the ends whereof are inserted into connector body 10.

It will be appreciated that embodiments as exemplified in FIG. 5 to FIG. 12 enable the implementation of the electrical connection of modules M without jeopardizing their performance from an optical point of view.

It will be appreciated, moreover, that one or more embodiments as exemplified herein offer the effect of enabling the connection of a wide range of modules M, without modifying the features thereof. One or more embodiments as exemplified herein, therefore, may easily be applied to a wide range of modules M already available on the market.

Finally, it will be appreciated that one or more embodiments may be used in combination both with modules M emitting white light and with modules M emitting coloured light.

In various embodiments, a connector is provided for connecting elongate (e.g. ribbon-shaped) lighting devices at the mutually facing ends thereof includes a body having opposed end regions coupleable to the facing ends of said lighting devices. The connector body includes a light emission region between said opposed end regions.

One or more embodiments aim at overcoming the previously described drawback.

According to one or more embodiments, a connector is provided having the features specifically set forth in the claims that follow.

One or more embodiments may also concern a corresponding method.

The claims are an integral part of the technical teaching provided herein with reference to the embodiments.

One or more embodiments enable the achievement of one or more of the following effects:

the possibility of coupling two or more modules while ensuring a constant pitch among the light radiation sources (e.g. LEDs) along the whole length of the resulting lighting device;

the possibility of installing e.g. two modules by using one single power supply connector, i.e. with one single cable for the end user;

the possibility of connecting modules in pairs in an intermediate position between the two, therefore achieving an additional degree of freedom for the lighting device installer.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A connector for connecting mutually facing ends of elongate lighting devices, the connector comprising:

a connector body comprising opposed end regions slidably engageable with said facing ends of said elongate lighting devices, the connector body comprising a light permeable region between said opposed end regions, wherein the connector body comprises:

a C-shaped configuration providing the light permeable region as an opening exposing light radiation from one or more light radiation sources located on the elongate lighting devices, or a light permeable material in the light permeable region for exposing light radiation from the one or more light radiation sources located on the elongate lighting devices; and an electrical power feed line including electrical cables, wherein the electrical power feed line includes electrical contacts for cooperation with said mutually facing ends of said lighting devices.

2. The connector of claim 1, wherein the light emission region in the connector body comprises the light permeable material for exposing light radiation from the one or more light radiation sources located on the elongate lighting devices.

3. The connector of claim 1, wherein the elongate lighting devices are elongated ribbon-shaped lighting devices.

4. The connector of claim 1, wherein the connector is slidably engageable on a first side with a first elongate lighting device of the elongate lighting devices; and wherein the connector is slidably engageable on a second side with a second elongate lighting device of the elongate lighting devices.

5. The connector of claim 1, wherein the light permeable material comprises a window to expose light from the opposed end regions of the elongate lighting device.

6. The connector of claim 1, wherein the connector body comprises the C-shaped configuration.

7. The connector of claim 1, wherein the electrical contacts are electrical sliding contacts connected to the electrical cables for providing electricity to the elongate lighted devices.

8. A method of connecting mutually facing end regions of elongate lighting devices, the method comprising:

providing a connector for connecting mutually facing ends of elongate lighting devices, the connector comprising:

a connector body comprising opposed end regions slidably engageable with said facing ends of said elongate lighting devices, the connector body comprising a light permeable region between said opposed end regions, wherein the connector body comprises:

a C-shaped configuration providing the light permeable region as an opening exposing light radiation from one or more light radiation sources located on the elongate lighting devices, or a light permeable material in the light permeable region for exposing light radiation from the one or more light radiation sources located on the elongate lighting devices; and an electrical power feed line including electrical cables, wherein the electrical power feed line includes electrical contacts for cooperation with said mutually facing ends of said lighting devices;

coupling said mutually facing ends of said lighting devices to said opposed end regions of said connector body.

9. A lighting system comprising:

a first elongate lighting device and a second elongate lighting device, each of the first and second elongate lighting devices comprising a plurality of electrically powered light radiation sources distributed with a uniform pitch to provide a uniform distribution of light emission along the length of the first or second elongate lighting devices; and a connector for connecting mutually facing ends of the first and second elongate lighting devices, the connector comprising:

a connector body comprising opposed end regions slidably engageable with the mutually facing ends of the first and second elongate lighting devices, the connector body comprising a light permeable region between the opposed end regions, wherein the connector body comprises a C-shaped configuration providing the light permeable region as an opening exposing one or more of the electrically powered light radiation sources which are located at the mutually facing ends of the first and second elongate lighting devices to expose light radiation from the first and second elongate lighting devices; and an electrical power feed line including electrical cables, wherein the electrical power feed line includes electrical contacts for cooperation with the mutually facing ends of said first and second lighting devices.

10. The lighting system of claim 9, wherein the electrical contacts are electrical sliding contacts connected to the electrical cables for providing electricity to the first and second elongate lighted devices.

* * * * *